US006336633B1

(12) United States Patent
Webb

(10) Patent No.: US 6,336,633 B1
(45) Date of Patent: Jan. 8, 2002

(54) METHOD AND APPARATUS FOR PLAYING A DICE GAME

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

(21) Appl. No.: 09/358,425

(22) Filed: Jul. 22, 1999

(51) Int. Cl.[7] ..... A63F 3/08
(52) U.S. Cl. ..... 273/274; 273/146
(58) Field of Search ..... 463/10, 16; 273/274, 273/139, 138.1, 146, 143 A

(56) References Cited

U.S. PATENT DOCUMENTS 4,743,025 A * 5/1988 Gramera
5,308,081 A * 5/1994 Bartle
5,413,351 A * 5/1995 Franklin
5,542,671 A * 8/1996 Stewart
5,573,248 A * 11/1996 Parra
5,700,010 A * 12/1997 Mimier
5,732,948 A * 3/1998 Yosloff
5,879,006 A 3/1999 Bowling

* cited by examiner

*Primary Examiner*—Benjamin H. Layno
*Assistant Examiner*—Vishu K. Mendiratta
(74) *Attorney, Agent, or Firm*—Nixon & Vanderhye P.C.

(57) ABSTRACT

A method and apparatus for playing a dice game utilizes advantageous aspects of the conventional Craps game while simplifying betting options. The game incorporates high-payoff wagers as well as a wager including no house advantage. The amount of the no house advantage wager is typically dependent upon the first wager and upon a role of the player. The game includes establishing a key player, receiving a primary wager that one of a plurality of events will occur, receiving an optional secondary wager that another of the plurality of events will occur, the key player rolling the plurality of dice, and resolving the primary wager and secondary wager based on the roll of the dice. The secondary wager is dependent upon the primary wager, which dependency is determined based on whether the player making the secondary wager is the key player.

23 Claims, 2 Drawing Sheets

METHOD AND APPARATUS FOR PLAYING A DICE GAME

BACKGROUND OF THE INVENTION

The present invention relates to a method and apparatus for playing a dice game and, more particularly, to a method and apparatus for playing a dice game that provides multiple wagering options and allows for active player participation.

Craps is a casino standard dice game wherein players take turns "shooting" a pair of dice while the shooter and other players make wagers on the dice result. The popularity of Craps relative to other casino games has decreased somewhat with new player reluctance to learn the game as well as an increasing number of casino game variations for play. There have been several attempts to introduce new dice games, but to-date, these games have had minimal impact. Mini-Craps, Crazy Bones and Mini-Dice are scaled down versions of Craps, and Pyramid Dice and Survival Dice use multiple roll numerical values.

For a novice player, the Craps layout, payoff scale and the procedure appear complicated. For the casino operator, Craps is a labor intensive game, typically with four staff dedicated to a table, compared to only one at a Blackjack table. Casino floor space is a valuable asset, but a Craps table requires double the space required by a Blackjack table. Moreover, staff training is more complicated due to betting and payoff complexities.

There are at least two features of Craps, however, that would be advantageously retained in any new dice game. First, the dice thrower or shooter retains the right to throw the dice until losing or "crapping out" according to the rules of the game. When a shooter is throwing with success, most players bet with the shooter, which thus encourages game sociability as most players are wishing for the same result. Second, there is an option for a bet with no house advantage. This option occurs after at least one roll when the shooter has established a "point." Casinos allow the secondary bet in proportion to a primary bet, with exact odds being offered and no casino advantage. This bet will typically take an average of a few rolls to resolve. The proportion allowed can be increased as a casino promotion, with the traditional relationship being 1× or 2× odds, up to the recent very liberal 100× odds. Two three-dice games, Sic-Bo and Chuck-a-luck, do not have either of these features and include other drawbacks such as poor payoffs on propositions. As a consequence, Chuck-a-luck is virtually not played in U.S. casinos today, and Sic-Bo has only minimal play.

SUMMARY OF THE INVENTION

It would thus be desirable to provide a new dice game that incorporates advantageous features of a traditional Craps game while encouraging novice play. A new dice game should additionally be operational by a single dealer, have a simple layout and occupy at most a similar floor area to a Blackjack table. The dice game should advantageously also include allowing any bet on any throw, dice throwing rights retention for a winning shooter, a wager option with no casino advantage, and a range of payoffs at fair odds on propositions.

According to the present invention, a method of playing a dice game using a plurality of dice is provided. The method includes (a) establishing a key player, (b) receiving a primary wager that one of a plurality of events will occur, (c) receiving an optional secondary wager that another of the plurality of events will occur, (d) the key player rolling the plurality of dice, and (e) resolving the primary wager and the secondary wager based on the roll of the dice. The secondary wager is dependent upon the primary wager, which dependency is determined based on whether the player making the secondary wager is the key player. Moreover, a payoff for the secondary wager is without a house advantage.

In a preferred embodiment, the primary wager is a wager that the rolled dice will include one or more of a specific symbol, and the secondary wager is a wager that the rolled dice will include more of a first type of result than a second type of result, such as odd numbers or even numbers. Step (e) may be practiced by paying a variable payoff on the primary wager, which is increased when one of the plurality of events is exceeded. That is, the variable payoff on the primary wager that the rolled dice will include one of a specific symbol is increased when the rolled dice includes two or three of the specific symbol. In a related context, the variable payoff on the primary wager that the rolled dice will include two of a specific symbol is increased when the rolled dice includes three of the specific symbol.

The secondary wager for a player other than the key player may be limited to an amount of the primary wager, and a secondary wager for the key player may be limited to a predetermined multiple amount of the primary wager such as two times the amount of the primary wager.

The game is typically played with three dice, and any suitable configuration of symbols on the three dice may be used including conventional dice. In one context, two of the three dice are identical. Two of the three dice each may be provided with six symbols and the third of the three dice may have one of (1) three sides each of two symbols, respectively, (2) two sides each of three symbols, respectively, or (3) six different symbols. When each of the three dice is different, the dice may include five symbols in common and a different sixth symbol.

Steps (b)–(e) may be practiced until the key player withdraws or places a losing secondary wager. Step (c) may be practiced such that the secondary wager can only be placed if the primary wager is placed. The role of the key player may be performed by the dealer. Alternatively, step (a) may be practiced by players taking turns.

In accordance with another aspect of the invention, there is provided a method of playing a dice game using a plurality of dice. The method includes (a) a player wagering that a first event will occur, (b) giving a player an option to wager that a second event will occur provided the player wagered on the first event, (c) rolling the plurality of dice, and (d) resolving wagers according to the roll of the dice. The amount of the second event wager is dependent upon the first event wager and upon a role of the player.

According to yet another aspect of the invention, there is provided an apparatus configured for playing a game using a plurality of dice. The apparatus includes a display, a player interface for receiving player input, and a processor configured to effect game play, wherein the processor enables the method according to the invention.

In accordance with still another embodiment of the invention, the apparatus includes structure for effecting the method according to the present invention.

In accordance with a further embodiment of the invention, there is provided a game including a playing surface having a plurality of betting areas and a plurality of dice. The betting areas include a first betting area for a primary wager that one of a plurality of events will occur, and a second betting area for a secondary wager that another of the plurality of events will occur. The secondary wager is dependent upon the primary wager, which dependency is determined based upon a role of the player making the secondary wager. Additionally, a payoff for the secondary wager is without a house advantage.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
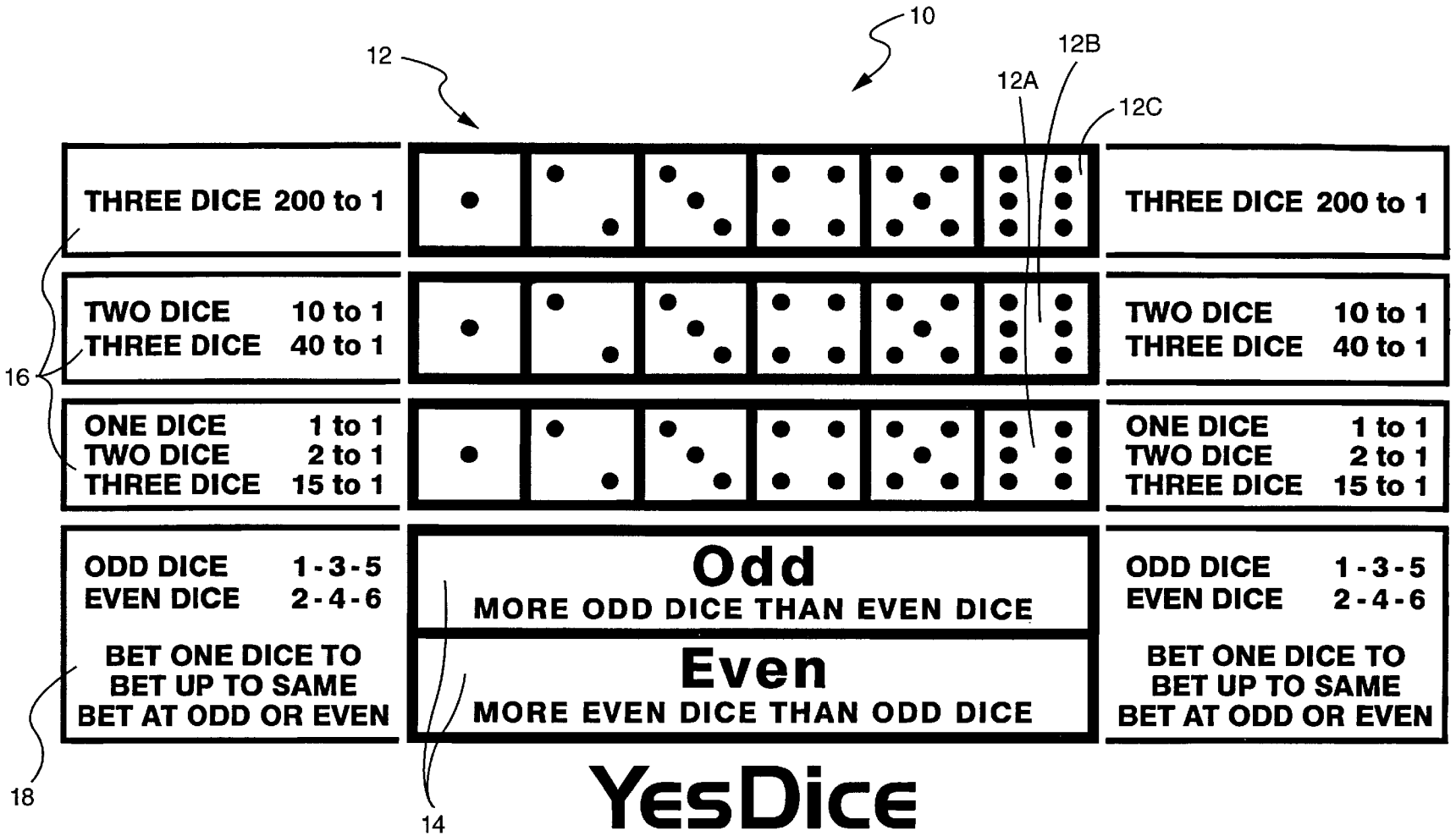
FIG. 1 is a plan view of a table arrangement according to the present invention.

The dice game according to the invention is played on a rectangular table with a dealer and preferably three dice. The table layout 10 is marked with bet areas 12, 14, payoff information 16, and rules 18 as in FIG. 1. There is also preferably a device (not shown) for shaking the dice, although the game may be played with the players shooting the dice from their hands. Each player makes one or more bets of choice, the appointed shooter shakes the dice, and bets are settled accordingly.

The layout 10 includes a primary wager area 12 for predicting one 12A, two 12B, or three 12C dice of a specific number, with a higher payoff applying where the prediction is exceeded. That is, as shown in the payoff areas 16, for example, if a player wagers that one dice will result in a particular number at waging area 12A and two of that particular number are rolled, the payoff is increased from 1 to 1 to 2 to 1. In the same example, if all three dice result in the predicted number, the payoff is further increased to 15 to 1. With a bet in waging area 12B that two dice will result in a particular number, in the event that three dice result in a predicted number, the payoff is increased from 10 to 1 to 40 to 1.

The layout 2 also includes two secondary bet areas 14 named ODD and EVEN. As noted in FIG. 1, an ODD wager is a prediction that more odd-numbered dice (1, 3, 5) will result than even-numbered dice (2, 4, 6). EVEN is the opposite prediction. It is preferable to require a bet in one of the waging areas 12A, 12B or 12C to enable a bet to be made at the waging area 14. The secondary wager at 14 is one that has no house advantage. Other secondary wagers that do not have a house advantage will be contemplated by those of ordinary skill in the art, and the invention is not meant to be limited to the illustrated ODD and EVEN wagers.

Prior to commencing the game, a key player is established. In a preferred embodiment, the key player is the shooter who retains dice shaking rights until placing a losing ODD or EVEN bet at 14. In an alternative embodiment, the key player is the dealer who shoots the dice as the players make wagers. Except for the key player, when the key player is not the dealer, a wager on ODD or EVEN at 14 is limited to the maximum amount bet in the primary waging areas 12. The key player, or shooter in this embodiment, must bet ODD or EVEN at 14 but has an option to bet a multiple of a primary wager such as two times the primary wager. That is, if the shooter makes a primary wager at 12 of, for example, ten dollars, the shooter must bet ODD or EVEN but has an option to bet a multiple of the ten dollar primary wager, such as twenty dollars.

As noted, the shooter retains dice shaking rights until placing a losing ODD or EVEN bet. The dice shaking right and thus the secondary wager multiple bet right then passes to the next player. With the no house advantage ODD and EVEN bets, there is a built-in incentive for players to participate in the game and be a shooter. Additionally, there is an incentive for players to play alone or short-handed, which will result in the players being shooters more often, thereby reducing the likelihood of a table being unused. A player who has been a shooter on a round of the table may move to a new player position, but preferably may not be allowed to be a shooter twice during that round. If no player wishes to be the shooter, then the dealer acts as the shooter. In this context, the key player may be established by the dealer with an indicator such as a card, light or other indicating device, granting the designated key player the shooter rights noted above.

After the dice are rolled, all losing number wagers are taken and all winning number wagers are paid as follows:

| BET | RESULT | PAYOFF |
|---|---|---|
| One dice | One dice | 1–1 |
| | Two dice | 2–1 |
| | Three dice | 15–1 |
| Two dice | Two dice | 10–1 |
| | Three dice | 40–1 |
| Three dice | Three dice | 200–1 |

The secondary ODD or EVEN wagers in betting area 14 are paid 1 to I and are resolved as follows:

| ODD WINS | EVEN WINS |
|---|---|
| odd-odd-odd | even-even-even |
| odd-odd-even | even-even-odd |

The dice are preferably conventional six-sided dice including the numbers 1–6. Alternatively, dice with letters or symbols could be used, and the ODD or EVEN wager renamed accordingly, as for example YesDice and NoDice. Also, an alternative number of dice could be used. Moreover, the dice could be different rather than identical, wherein two of the three dice each is provided with six symbols and the third of the three dice has one of (1) three sides each of two symbols, respectively, (2) two sides each of three symbols, respectively, or (3) six different symbols. Each of the three dice may also be different including five symbols in common with a different sixth symbol. That is, each dice may be provided with five symbols, numbers or letters with, for example, Y for YesDice on one dice and N for NoDice on another dice and T for tie on the other(s), creating a slower resolution of the "free" bet. That is, if the "T" is rolled, regardless of whether a Y or N is rolled, the YesDice and NoDice wagers would be pushed (tied) and the bets held for the next roll.

As would be apparent to those skilled in the relevant art, the invention can be embodied in a wide variety and forms of media, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disc, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
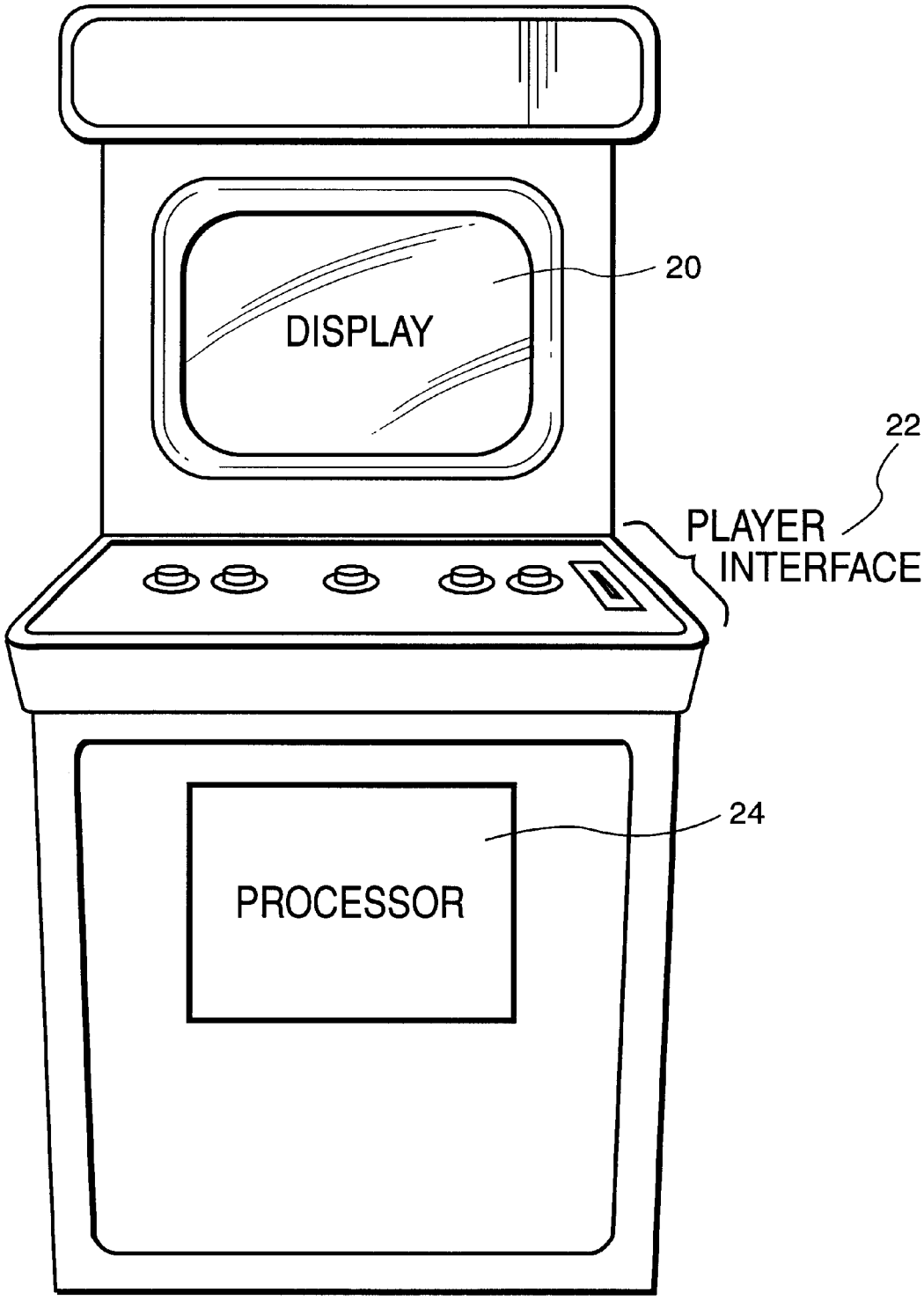
FIG. 2 is a schematic diagram illustrating the structure effecting game play according to the apparatus of the present invention.

In this context, referring to FIG. 2, a schematic arrangement is illustrated showing the components of an apparatus configured for playing the game according to the invention. The apparatus includes a display 20, a player interface 22, and circuitry 24 such as a CPU for effecting game play according to the rules of the game. The apparatus can be a single player unit as shown, which can randomly generate temporary key player wager privileges, or can be embodied in a multi-player unit, which can allow a key player in respect of both shooting and wager benefits.

With the methodology according to the present invention, the advantages of a conventional Craps dice game can be utilized while providing a game that is easy to understand and exciting to play. The result is a more enjoyable and playable game that is suited for players of all levels.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a dice game using a plurality of dice, the method comprising:

(a) establishing a key player;

(b) receiving a primary wager that one of a plurality of events will occur;

(c) receiving an optional secondary wager that another of the plurality of events will occur, wherein the secondary wager is dependent upon the primary wager, the dependency being determined based on whether a player making the secondary wager is the key player, and wherein a payoff for the secondary wager is without a house advantage;

(d) the key player rolling the plurality of dice; and (e) resolving the primary wager and the secondary wager based on the roll of the dice.

2. A method according to claim 1, wherein the primary wager is a wager that the rolled dice will include one or more of a specific symbol, and wherein the secondary wager is a wager that the rolled dice will include more of a first type of result than a second type of result.

3. A method according to claim 2, wherein the first type of result is one of odd numbers or even numbers, and wherein the second type of result is the other of odd numbers or even numbers.

4. A method according to claim 3, wherein the secondary wager is resolved according to the following:

| ODD WINS | EVEN WINS |
|---|---|
| odd-odd-odd | even-even-even |
| odd-odd-even | even-even-odd. |

5. A method according to claim 2, wherein step (e) is practiced by paying a variable payoff on the primary wager, the variable payoff being increased when the one of the plurality of events is exceeded.

6. A method according to claim 5, wherein the variable payoff on the primary wager that the rolled dice will include one of a specific symbol is increased when the rolled dice includes two or three of the specific symbol, and wherein the variable payoff on the primary wager that the rolled dice will include two of a specific symbol is increased when the rolled dice includes three of the specific symbol.

7. A method according to claim 6, wherein step (e) is practiced for the primary wager according to the following:

| BET | RESULT | PAYOFF |
|---|---|---|
| One dice | One dice | 1–1 |
| | Two dice | 2–1 |
| | Threedice | 15–1 |
| Two dice | Two dice | 10–1 |
| | Three dice | 40–1 |
| Three dice | Three dice | 200–1. |

8. A method according to claim 1, wherein the secondary wager for a player other than the key player is limited to an amount of the primary wager, and wherein the secondary wagers for the key player is limited to a predetermined multiple amount of the primary wager.

9. A method according to claim 8, wherein the secondary wager for the key player is limited to two times the amount of the primary wager.

10. A method according to claim 1, wherein the secondary wager payoff is 1 to 1.

11. A method according to claim 1, comprising the step of providing three dice.

12. A method according to claim 11, wherein two of the three dice are identical.

13. A method according to claim 12, wherein two of the three dice each is provided with six symbols and the third of the three dice has one of (1) three sides each of two symbols, respectively, (2) two sides each of three symbols, respectively, or (3) six different symbols.

14. A method according to claim 11, wherein each of the three dice is different including five symbols in common and a different sixth symbol.

15. A method according to claim 1, wherein steps (b)–(e) are practiced until the key player withdraws or places a losing secondary wager.

16. A method according to claim 1, wherein step (c) is practiced such that the secondary wager can only be placed if the primary wager is placed.

17. A method according to claim 1, wherein the key player is a dealer.

18. A method according to claim 1, wherein step (a) is practiced by players taking turns.

19. A method of playing a dice game using a plurality of dice, the method comprising:

(a) a player wagering that a first event will occur;

(b) giving the player an option to wager that a second event will occur provided the player wagered on the first event, wherein the amount of the second event wager is dependent upon the first event wager and upon a role of the player;

(c) rolling the plurality of dice; and (d) resolving wagers according to the roll of the dice.

20. A method according to claim 19, wherein the first event comprises one of the roll of the dice including one or more of a specific symbol.

21. A method according to claim 19, wherein the second event comprises the roll of the dice including more of a first type of result than a second type of result.

22. A method according to claim 21, wherein the first type of result is one of odd numbers or even numbers, and wherein the second type of result is the other of odd numbers or even numbers.

23. An apparatus for playing a dice game using a plurality of dice, the apparatus comprising:

means for establishing a key player;

means for receiving a primary wager that one of a plurality of events will occur;

means for receiving an optional secondary wager that another of the plurality of events will occur, wherein the secondary wager is dependent upon the primary wager, the dependency being determined based on whether a player making the secondary wager is the key player, and wherein a payoff for the secondary wager is without a house advantage;

means for the key player to effect rolling of the plurality of dice; and means for resolving the primary wager and the secondary wager based on the roll of the dice.

* * * * *